United States Patent [19]

Kongou

[11] Patent Number: 5,012,714

[45] Date of Patent: May 7, 1991

[54] BRASS INSTRUMENT

[75] Inventor: Akihiko Kongou, Shizuoka, Japan

[73] Assignee: Yamaha Corporation, Hamamatsu, Japan

[21] Appl. No.: 409,942

[22] Filed: Sep. 19, 1989

[30] Foreign Application Priority Data

Sep. 19, 1988 [JP] Japan ..... 63-234320

[51] Int. Cl.[5] ..... G10D 9/04

[52] U.S. Cl. ..... 84/390; 84/392

[58] Field of Search ..... 84/390, 392

[56] References Cited

U.S. PATENT DOCUMENTS

| | | | |
|---|---|---|---|
| 1,244,745 | 10/1917 | King | 84/390 |
| 2,003,995 | 6/1935 | Einhorn | 84/392 |
| 2,484,408 | 10/1949 | Hubley | 84/390 |
| 3,641,863 | 2/1972 | Kanstul et al. | 84/390 |
| 3,881,388 | 5/1975 | McCracken | 84/388 |
| 4,112,806 | 9/1978 | Thayer | 84/390 |

FOREIGN PATENT DOCUMENTS

| | | | |
|---|---|---|---|
| 114573 | 10/1929 | Fed. Rep. of Germany | 84/390 |
| 2918247 | 5/1980 | Fed. Rep. of Germany | 84/392 |

*Primary Examiner*—Lawrence R. Franklin

*Attorney, Agent, or Firm*—Burns, Doane, Swecker & Mathis

[57] ABSTRACT

A brass instrument such as a trombone has a main tube member formed with a main air passage, a plurality of bypassing tube members respectively formed with bypassing air passages, and a plurality of valve units selectively coupling the main air passage to the bypassing air passages for variation in pitch of the sound produced therein, and each of the valve units is provided with two three port valve assemblies linked with each other for simultaneously being shifted between two positions, in which each of the valve assemblies has three ports angularly paced apart from one another by angles of about 120 degrees, so that the valve assemblies are less causative of resistance to the vibratile air column, thereby providing a comfortable feeling to the player.

5 Claims, 5 Drawing Sheets

BRASS INSTRUMENT

FIELD OF THE INVENTION

This invention relates to a brass instrument such as, for example, a trumpet, a French horn or a trombone and, more particularly, to valve units provided in the brass instrument for permitting variation in the pitch of the sound produced therein.

BACKGROUND OF THE INVENTION

A brass instrument is sounded by buzzing the lips of the player against the mouthpiece, and the sounds produced therein are varied by manipulating the valve units. Namely, in the brass instrument is defined a column of air which is vibrated by buzzing the lips. The vibrating length of the column of air is directly related to the pitch of the sound produced, and the vibrating length is varied by manipulating one of the valve units.

A typical example of the brass instrument is shown in FIG. 1 in a modeled form, and largely comprises a funnel-shaped mouthpiece 1, a open-cone 3, a main tube member 5 interconnecting the mouthpiece 1 and the open cone 3, and three valve units 7, 9 and 11. The valve units 7, 9 and 11 are operative to couple bypassing tube members 13, 15 and 17 to the main tube member 5, respectively, thereby connecting additional lengths of tubing for the variation in the pitch of the sound produced therein.

The valve units are of the four-port rotary valve illustrated in FIG. 2 of the drawings. The valve units 7, 9 and 11 are similar in construction to one another, and, for this reason, description is made for the valve units 7 with reference to FIG. 2. The valve units 7 largely comprises a valve casing 19, a rotor 21 coupled to a key member 23. The valve casing 19 is provided with four ports 25, 27, 29 and 31, and two air conduits 33 and 35 are formed in the rotor 21. The rotor 21 is tightly received, but rotatable in the valve casing 19, and, for this reason, the air conduits 33 and 35 conduct the air without any serious leakage. Each of the air conduits 33 and 35 is bent at both end portions thereof, and one end portion of the air conduit 33 extends at right angles with one end portion of the air conduit 35.

The valve unit 7 is shiftable between first and second positions one of which allows the air conduit 33 to couple the port 27 to the port 29, and the other of which establishes an air passage from the port 27 through the air conduit 33, the bypassing air conduit 13, the port 31 and the air conduit 35 to the port 29. When the valve unit 7 remains in the first position, the air conduit 33 intervenes in the main tube member 5, and, accordingly, the column of air is relatively short. Then, if the player buzzes the lips, the relatively short column of air produces the vibration with a high pitch. In this situation, if the player manipulates the key member 23 to shift the valve unit 7 into the second position, the column of air is prolonged by the bypassing tube member 13, and, for this reason, the sound produced therein is lowered by a predetermined pitch.

However, a problem is encountered in the prior art brass instrument in that the player feels a difference in the air resistance depending upon the positions of the valve units 7, 9 and 11. This is because of the fact that each of the air conduits 33 and 35 are sharply bent in each rotor due to their being small in size, and, accordingly, the small radius of curvature imparts a substantial amount of resistance to the air passing therethrough.

The difference in the air resistance is uncomfortable for the player and rather hard on the nerves. The variation in the air resistance further results in a difference in the tone color.

SUMMARY OF THE INVENTION

It is therefore an important object of the present invention to provide a brass instrument which provides a comfortable to the player.

It is another important object of the present invention to provide a brass instrument which produces sounds with a constant tone color.

It is still another important object of the present invention to provide a valve unit which provides a constant air resistance regardless of the position thereof.

To accomplish these objects, the present invention proposes to form each valve unit by using two three port rotary valve assemblies linked with each other.

In accordance with the present invention, there is provided a brass instrument having a vibratile column of air for producing a sound, comprising: (a) a mouthpiece having a first air passage and propagating a buzzing to the vibratile column of air; (b) a main tube member having a second air passage connected to the first air passage; (c) a plurality of bypassing tube members respectively having a plurality of bypassing air passages; (d) a plurality of valve units respectively provided in association with the bypassing tube members, each of the valve units allowing the sound to change its pitch depending upon a position thereof regardless of a position of another valve unit; and (e) a plurality of manipulating members respectively provided in association with the valve units and operative to shift the valve units between first and second positions, respectively, in which each of the valve units comprises a first valve assembly having a first port coupled to the second air passage, a second port also coupled to the second air passage, a third port coupled to the bypassing air passage of the associated bypassing tube member and a first air conduit interconnecting the first and second ports in the first position and the first and third ports in the second position, a second valve assembly having a fourth port coupled to the second air passage, a fifth port also coupled to the second air passage, a sixth port coupled to the bypassing air passage of the associated bypassing tube member and a second air conduit interconnecting the fourth and sixth ports in the first position and the fifth and sixth ports in the second position, and a link mechanism allowing the first and second valve assemblies to be simultaneously shifted between the first and second positions, and in which the first and second air passages and the valve units or the first, second and bypassing air passages and the valve units form in combination the vibratile column of air depending upon the positions of the valve units, the first valve assembly comprising a first valve casing provided with the first, second and third ports, and a first valve rotor rotatably inserted in the valve casing and having the first air conduit, the first valve rotor having a rotational axis, the second valve assembly comprising a second valve casing provided with the fourth, fifth, and sixth ports, and a second valve rotor rotatably inserted in the valve casing and having the second air conduit, the second valve rotor having a rotational axis, the first valve casing being separated from the second valve casing, the link mechanism comprising a first lug portion connected to the associated manipulator and causing the first valve rotor to rotate around the rotational axis thereof, a first coupling portion driven for rotation together with the first valve rotor, a second lug portion causing the second valve rotor to rotate around the rotational axis thereof, and a connecting rod turnably connected at one end thereof to the first coupling portion and at the other end thereof to the second lug portion.

BRIEF DESCRIPTION OF THE DRAWINGS

The features and advantages of a brass instrument according to the present invention will be more clearly understood from the following description taken in conjunction with the accompanying drawings in which.

DESCRIPTION OF THE PREFERRED EMBODIMENT

Figure 1:
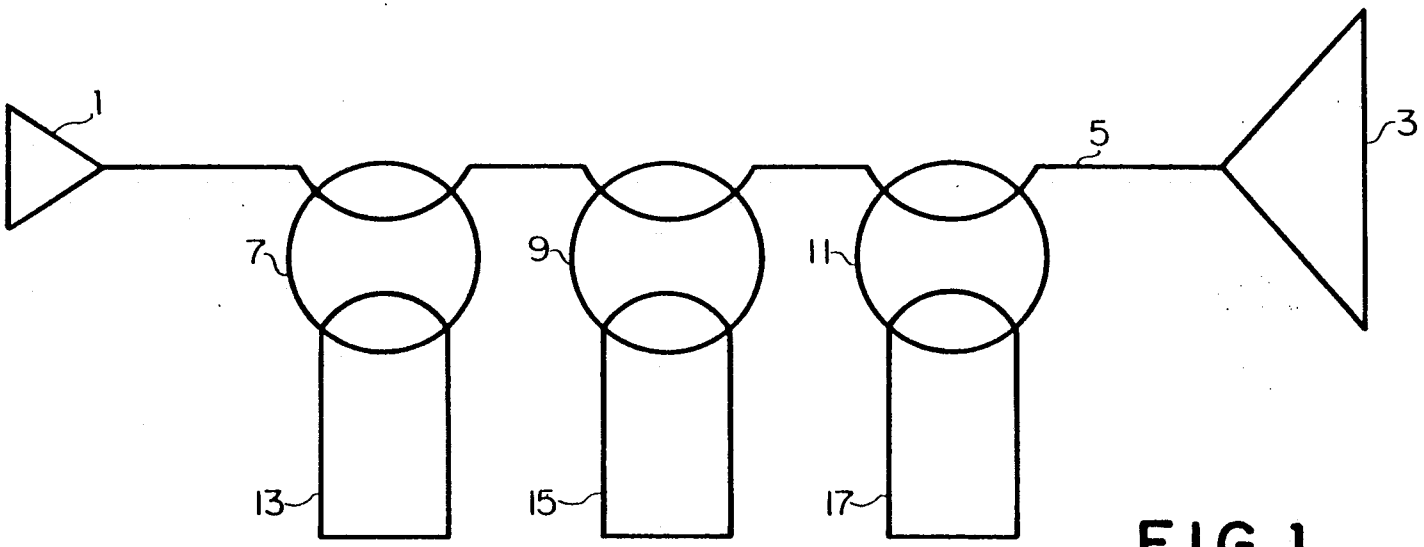
FIG. 1 PRIOR ART
FIG. 1 is a diagram showing, in a modeled form, a prior art brass instrument.
Figure 2:
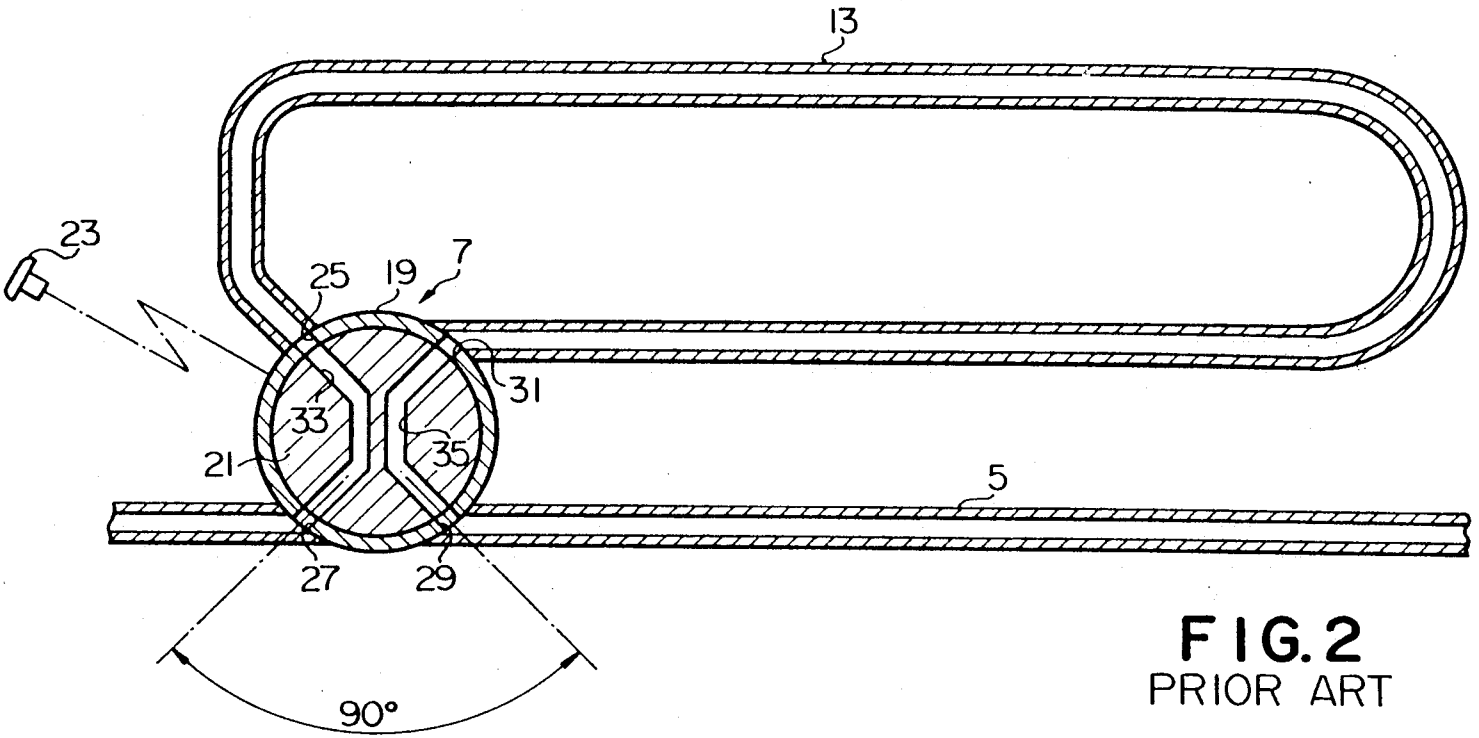
FIG. 2 PRIOR ART
FIG. 2 is a cross sectional view showing the valve unit incorporated in the brass instrument shown in FIG. 1.
Figure 3:
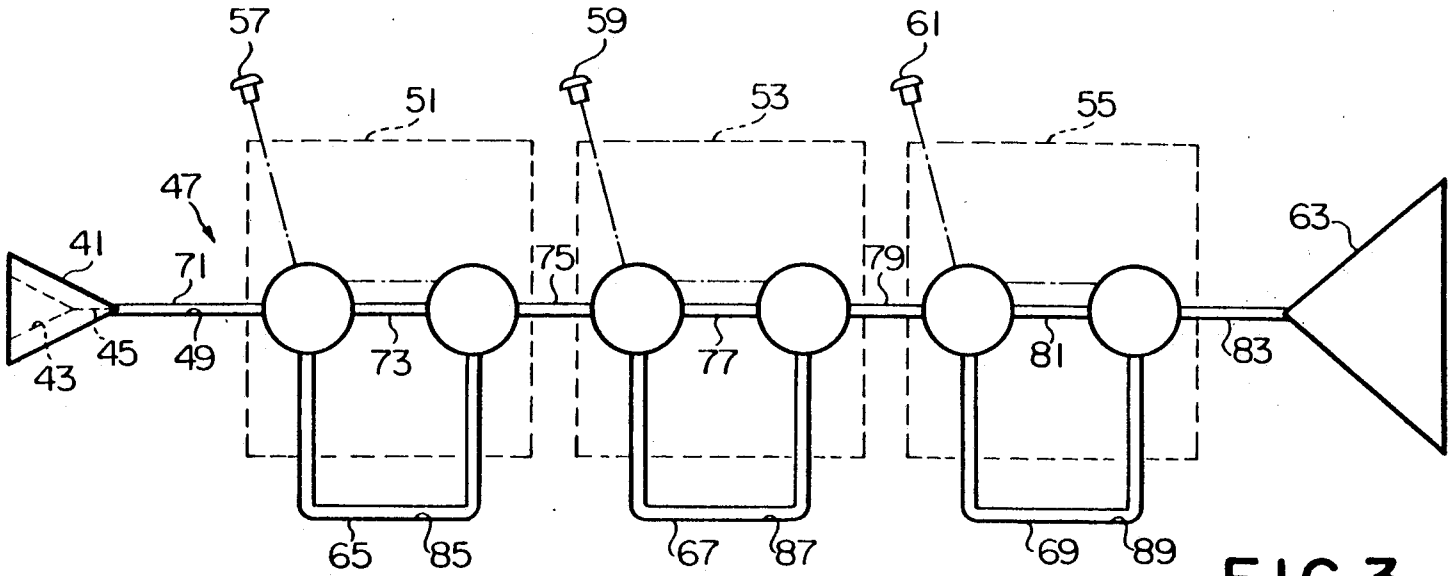
FIG. 3 is a diagram showing, in a modeled form, a brass instrument embodying the present invention.

Referring first to FIG. 3 of the drawings, a brass instrument embodying the present invention is illustrated, and is of the valve-tronbone. The brass instrument shown in FIG. 3 largely comprises a funnel-shaped mouthpiece 41 having a concavity 43 contiguous to a first air passage 45, a main tube 47 having a second air passage 49, three valve units 51, 53 and 55, three manipulators 57, 59 and 61 provided in association with the valve units 51 to 55, respectively, an open cone 63, and three bypassing tube members 65, 67 and 69 coupled to the valve units 51, 53 and 55, respectively.

The main tube 47 is constituted by seven short tube members 71, 73, 75, 77, 79, 81 and 83 having respective through holes which form in combination the second air passage 49. The bypassing tube members 65, 67 and 69 are respectively formed with bypassing air passages 85, 87 and 89. If the tube member 73 is tapered, each of the bypass tube members 65 to 69 can be provided with a taper portion independently from the tube member 73. The valve units 51 to 55 are similar in structure to one another, and description is made for the valve unit 51 only for avoiding the repetition.

Figure 4:
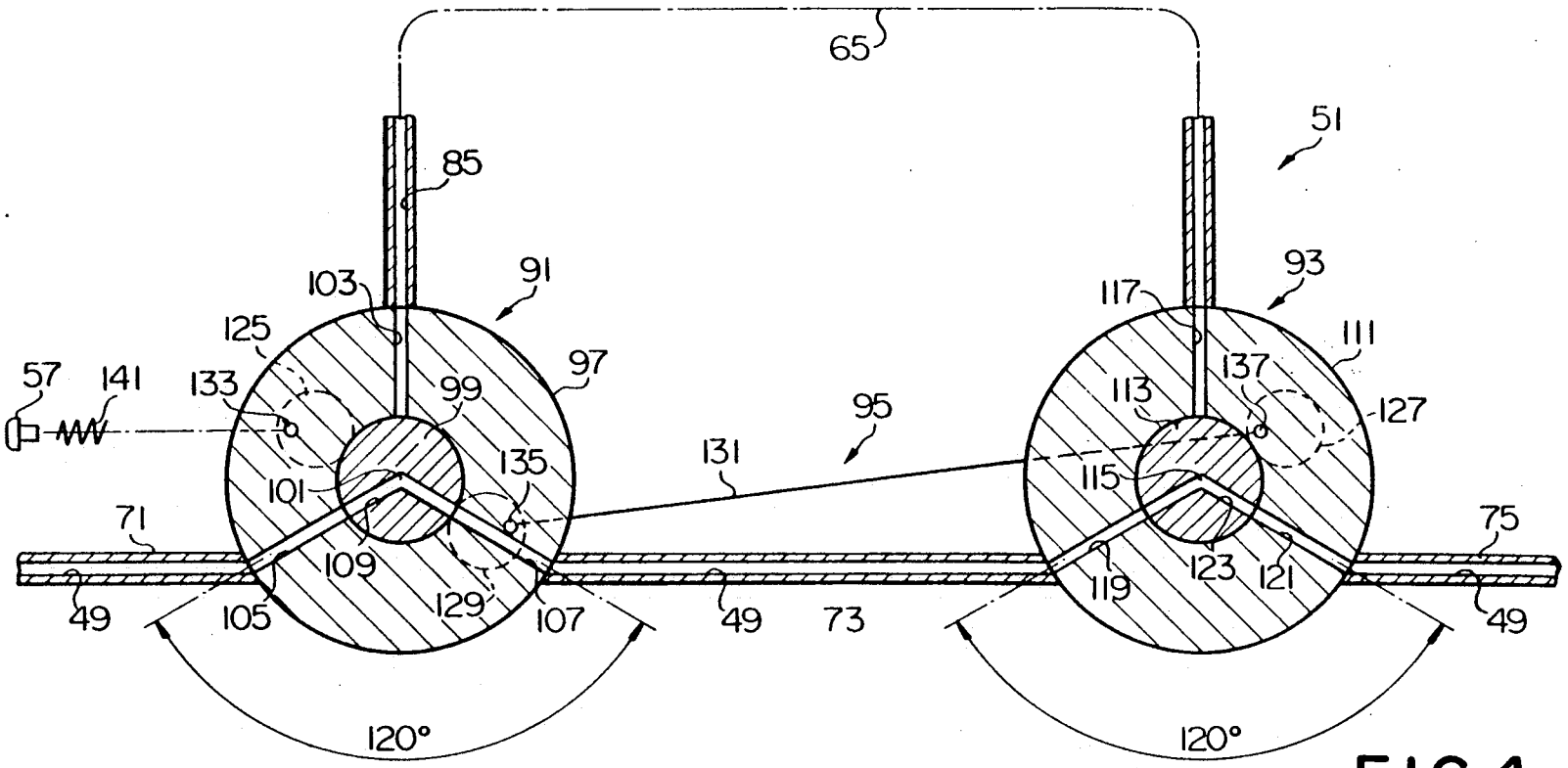
FIG. 4 is a cross sectional view showing the arrangement of each valve unit in one position incorporated in the brass instrument shown in FIG. 3.

Turning to FIG. 4 of the drawings, the valve unit 51 largely comprises a first valve assembly 91, a second valve assembly 93 and a link mechanism 95, and the first and second valve assemblies are of the three port rotary valve.

The first valve assembly 91 has a valve casing 97 and a valve rotor 99, and the valve rotor 99 is tightly received in the valve casing 97, however, is rotatable with respect to a rotational axis 101. The valve casing 97 is formed with three ports 103, 105 and 107, and the port 105 is directed away from the ports 103 and 107 by respective angles of about 120 degrees. The valve rotor 99 has a first air conduit 109 which is also curved at about 120 degrees, and, for this reason, the first air conduit 109 interconnects the ports 105 and 107 and, alternatively, the ports 105 and 103 depending upon an angular position thereof. The second valve assembly 93 has a valve casing 111 and a valve rotor 113, and the valve rotor 113 is tightly received in the valve casing 111, however, is rotatable with respect to a rotational axis 113. The valve casing 111 is formed with three ports 117, 119 and 121, and the port 119 is directed away from the ports 117 and 121 by respective angles of about 120 degrees. The valve rotor 115 has a second air conduit 123 which is also curved at about 120 degrees, and, for this reason, the second air conduit 123 also interconnects the ports 119 and 121 and, alternatively, the ports 121 and 117 depending upon an angular position thereof.

The link mechanism 95 comprises two lug portions 125 and 127 fixed to the valve rotors 99 and 113, respectively, a coupling portion 129 fixed to the valve rotor 99, and a connecting rod 131. The lug portion 125 is turnably coupled to the manipulator 57 through a pin member 133, and allows the valve rotor 99 to rotate around the rotational axis 101 when the manipulator 57 is pushed. The coupling portion 129 is disposed symmetrically with respect to the valve rotor 99, so that the coupling portion 129 is driven for rotation around the rotational axis 101 thereof together with the valve rotor 99. The connecting rod 131 is turnably coupled at one end thereof to the coupling portion 129 by means of a pin member 135, and the other end of the connecting rod 131 is also turnably coupled to the lug portion 127 by means of a pin member 137. Since the lug portion 127 is fixed to the valve rotor 113, the valve rotor 113 is driven for rotation around the rotational axis 115 by the connecting rod 131. The lug portion 125, the coupling portion 129 and the lug portion 127 are integral with the valve rotors 99 and 113, respectively, but these portions may be separately formed and incorporated with the valve rotors 99 and 113.

Figure 5:
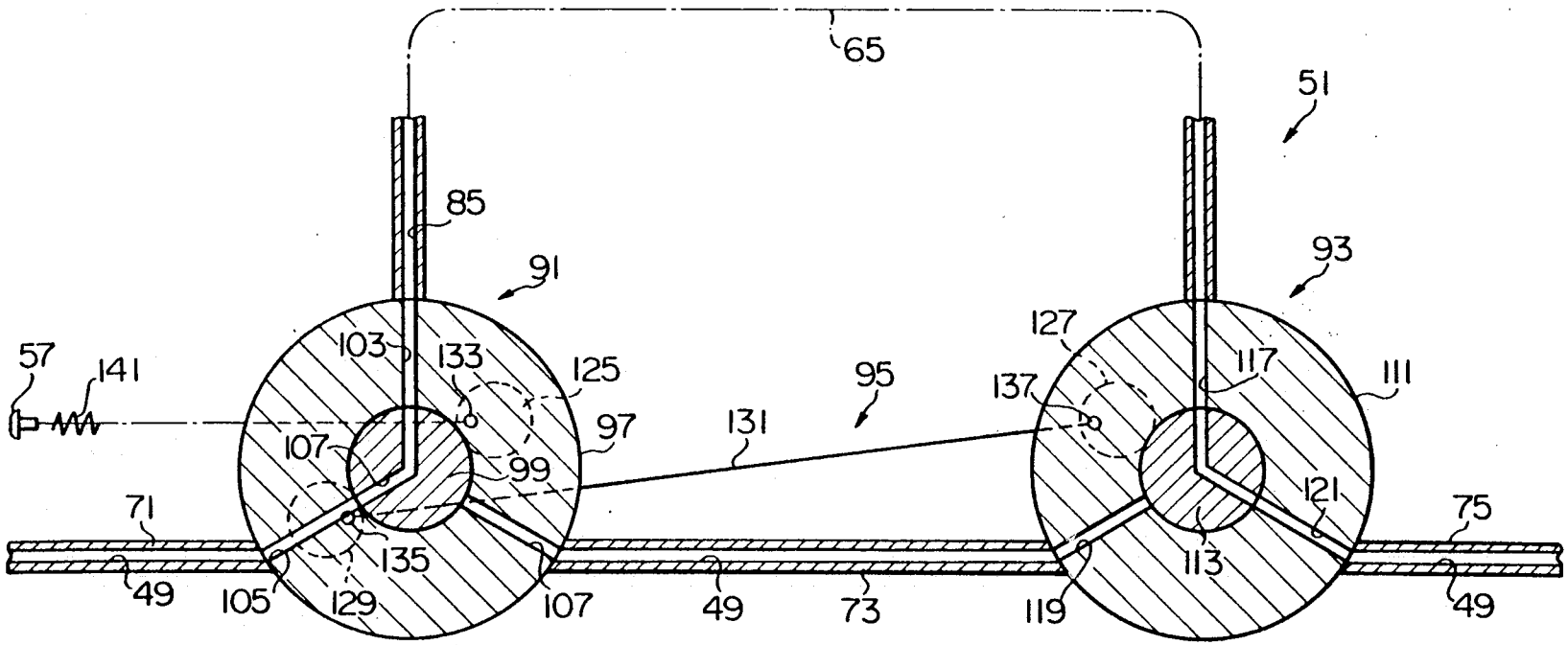
FIG. 5 is a cross sectional view showing the arrangement of the valve unit in a different position.

When the player pushes the manipulator 57, the lug portion 125 and, accordingly, the valve rotor 99 are driven for rotation in the clockwise direction, and the coupling portion 129 also travels around the rotational axis 101 in the clockwise direction. The coupling portion 129 pulls the connecting rod 131, and the lug portion 127 causes the valve rotor 113 to rotate around the rotational axis 115 in the counter-clockwise direction. If the angular positions shown in FIG. 4 is defined as a first or bypass closing position, the valve unit 51 is shifted from the first position to a second position where a second air passage 49 is connected to the bypass air passage 85 through the first and second air conduits 109 and 123 as shown in FIG. 5.

The manipulator 57 is associated with, for example, a coil spring 141, and, for this reason, the valve unit 51 is shifted from the second position to the first position when the finger of the player is left from the manipulator 57.

When the player's lips are buzzed without pushing any manipulators, the mouthpiece 41 propagates the vibration to a column of air and the length of which is defined by the first and second air passages 45 and 49 and the first and second air conduits 109 and 123. Then, the brass instrument produces a sound, and the sound has a pitch corresponding to the length of the air column.

However, if the player wants to lower the sound, the player pushes the manipulator 57, and, accordingly, the valve unit 51 is shifted from the first position to the second position. In the second position, the column of air is defined by the first, second and bypassing air passages 45, 49 and 85 as well as the first and second air conduits 109 and 123. The length of the air column is thus increased by adding the bypassing air passage 85, so that the sound is slightly lowered than the sound in the first position. The first and second air conduits are curved at about 120 degrees, so that the air resistance are not drastically changed even if the valve unit 51 is shifted between the first and second positions. In other words, the player is less susceptible to the position of the valve unit 51, and, for this reason, the player comfortably continues to play the brass instrument. The substantially constant air resistance further results in stable tone color.

Although particular embodiment of the present invention have been shown and described, it will be obvious to those skilled in the art that various changes and modifications may be made without departing from the spirit and scope of the present invention. For example, the present invention is applicable to another brass instrument such as, for example, a horn. In the horn, the regulating valve mechanism may be implemented by the valve unit according to the present invention without drastically increasing the occupation space.

What is claimed is:

1. A brass instrument having a vibratile column of air for producing a sound, comprising:

(a) a mouthpiece having a first air passage and propagating a buzzing to said vibratile column of air;

(b) a main tube member having a second air passage connected to said first air passage;

(c) a plurality of bypassing tube members respectively having a plurality of bypassing air passages;

(d) a plurality of valve units respectively provided in association with said bypassing tube members, each of said valve units allowing the sound to change its pitch depending upon a position thereof regardless of a position of another valve unit; and (e) a plurality of manipulating members respectively provided in association with said valve units and operative to shift the valve units between first and second positions, respectively, in which each of said valve units comprises a first valve assembly having a first port coupled to said second air passage, a second port also coupled to said second air passage, a third port coupled to the bypassing air passage of said associated bypassing tube member and a first air conduit interconnecting said first and second ports in said first position and said first and third ports in said second position, a second valve assembly having a fourth port coupled to said second air passage, a fifth port also coupled to said second air passage, a sixth port coupled to the bypassing air passage of said associated bypassing tube member and a second air conduit interconnecting said fourth and fifth ports in said first position and said fourth and sixth ports in said second position, and a link mechanism allowing said first and second valve assemblies to be simultaneously shifted between said first and second positions, and in which said first and second air passages and said valve units or said first, second and bypassing air passages and the valve units form in combination said vibratile column of air depending upon the positions of said valve units, said first valve assembly comprising a first valve casing provided with said first, second and third ports, and a first valve rotor rotatably inserted in the valve casing and having said first air conduit, said first valve rotor having a rotational axis, said second valve assembly comprising a second valve casing provided with said fourth, fifth and sixth ports, and a second valve rotor rotatably inserted in the valve casing and having said second air conduit, said second valve rotor having a rotational axis, said first valve casing being separated from said second valve casing, said link mechanism comprising a first lug portion connected to said associated manipulator and causing said first valve rotor to rotate around the rotational axis thereof, a first coupling portion driven for rotation together with the first valve rotor, a second lug portion causing said second valve rotor to rotate around the rotational axis thereof, and a connecting rod turnably connected at one end thereof to said first coupling portion and at the other end thereof to said second lug portion, each of said first and second air conduits forming a 120 degree bend between the opposite ends thereof and each of said valve assemblies being connected to said second air passage so that said vibratile column of air turns at 30 degrees at the interface between said second air passage and said first port, at 60 degrees in said first air conduit, at 30 degrees at the interface between said second port and said second air passage, at 30 degrees at the interface between said second air passage and said fourth port, at 60 degrees in said second air conduit and at 30 degrees at the interface between said fifth port and said second air passage while said first and second valve assemblies are held in said first position.

2. A brass instrument as set forth in claim 1, in which said first port is directed away from said second and third ports at respective angles greater than right angles.

3. A brass instrument as set forth in claim 1, in which said first port is directed away from said second and third ports at respective angles of about 120 degrees.

4. A brass instrument as set forth in claim 1, in which each of said manipulators includes a pushing member and a coil spring.

5. A brass instrument as set forth in claim 1, in which said brass instrument is of the trombone.

* * * * *